United States Patent [19]

Sahler

[11] Patent Number: 4,531,736

[45] Date of Patent: Jul. 30, 1985

[54] ACTION CROQUET POST

[75] Inventor: John T. Sahler, East Aurora, N.Y.

[73] Assignee: The Quaker Oats Company, Chicago, Ill.

[21] Appl. No.: 578,472

[22] Filed: Feb. 9, 1984

[51] Int. Cl.[3] ..... A63B 63/00

[52] U.S. Cl. ..... 273/56; 273/112; 273/127 R; 273/381; 273/385

[58] Field of Search ..... 272/76; 273/56, 57, 273/127 R, 177 R, 177 A, 177 B, 181 J, 381, 382, 383, 385, 386, 387, 389, 112

[56] References Cited

U.S. PATENT DOCUMENTS

| | | | |
|---|---|---|---|
| 303,016 | 8/1884 | Iske | 272/76 X |
| 694,226 | 2/1902 | Yancey | 272/76 X |
| 1,277,799 | 9/1918 | Weber | 272/76 X |
| 1,534,522 | 4/1925 | Halliday | 273/127 R X |
| 2,010,282 | 8/1935 | Wannemacher | 273/127 R X |
| 2,394,802 | 2/1946 | Osborn | 273/127 R |
| 2,417,565 | 3/1947 | Norvell | 273/112 X |
| 2,459,559 | 1/1949 | Watkins | 273/177 R |
| 2,821,398 | 1/1958 | Armstrong | 273/127 R |

FOREIGN PATENT DOCUMENTS

| | | | |
|---|---|---|---|
| 603195 | 1/1926 | France | 273/112 |

*Primary Examiner*—Harland S. Skogquist
*Attorney, Agent, or Firm*—Cumpston & Shaw

[57] ABSTRACT

A croquet post includes a base having a movable target and an activating arm attached to the target. A post extends upwardly from the base. A movable collar is supported by the post and is engaged by pins extending from a rod within the post. The rod is actuated by the arm to release the collar and allow it to slide down the post thereby providing a visible indication when the target is struck. A bell is struck by the rod providing an audible indication when the target is struck.

13 Claims, 2 Drawing Figures

ACTION CROQUET POST

This invention relates in general to a post for use in playing croquet and more particularly to a croquet post responsive to being struck by a ball to provide a visible and an audible indication thereof.

The game of croquet has a number of features that make it attractive for children. Certain other aspects of the game, however, make the game less than ideal for play by children and one of these is the necessity for determining whether the ball has hit the stake positioned behind the double wickets at each end of the croquet playing field. Heretofore, a wooden stake has normally been provided. While it is often possible to determine whether the ball has struck the stake by sound or by careful observation, a slow moving ball may strike the stake quite softly and create very little sound. Observation is likely to be unreliable and cause disagreement. The elimination of disagreements between children is desirable.

Accordingly, it is an object of this invention to provide a croquet post that is responsive to being struck by a ball to provide an immediately observable indication thereof.

It is another object of this invention to provide such a croquet post that is capable of providing an indication of at least two successive hits without the need for resetting.

It is still another object of this invention to provide a croquet post that responds to being struck by a ball by providing a visible indication thereof that is in itself entertaining.

Briefly stated and in accordance with a presently preferred embodiment of this invention, a croquet post is provided having a base, including a movable target mounted therein; an upstanding post projecting from said base and carrying a preferably attractive collar therearound, which collar may include one or more ornamental projections therefrom; a groove or track on said post for guiding said collar; a rod extending through a wall of the post for releasing said collar when said target is struck, thereby allowing the collar to slide down said post; and a bell mounted atop the post adapted to be struck by said rod in response to the impact of a ball on the target to provide an audible indication thereof. In accordance with an alternative embodiment of this invention, a spiral groove is provided and the collar has an inwardly projecting member engaging said groove for causing said collar to spin down the post.

The aspects of the invention that are regarded as novel are set forth in the appended claims.

Figure 1:
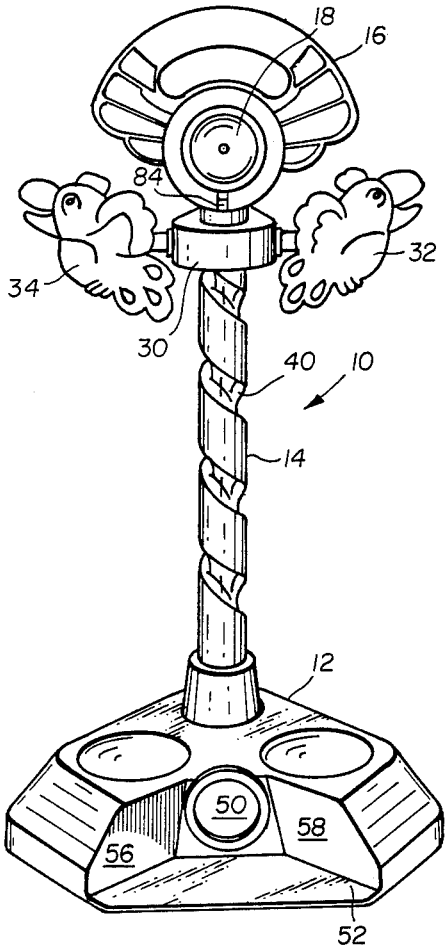
Figure 2:
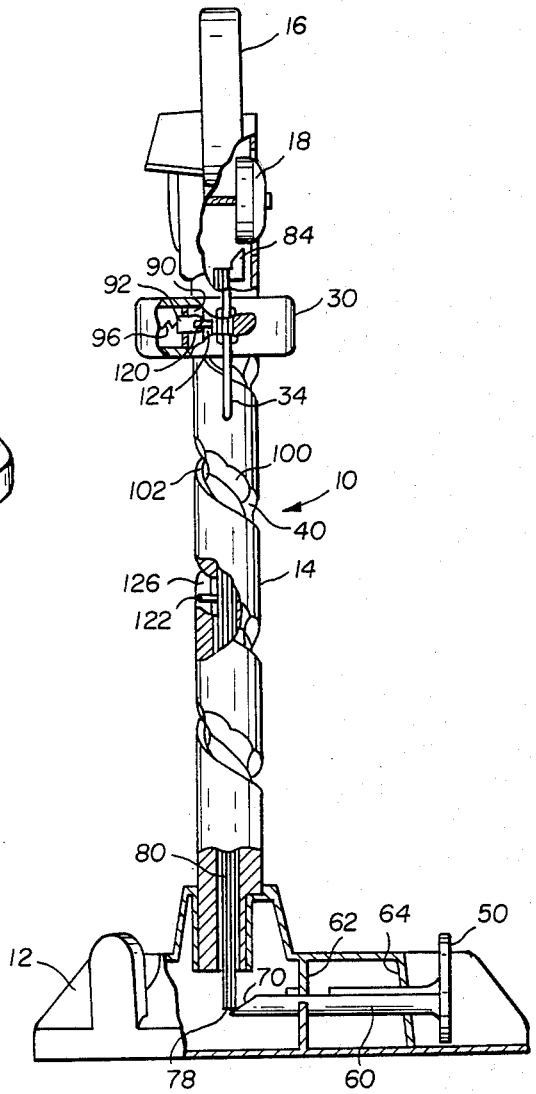

The invention itself, along with further objects and features thereof, may be more readily understood by reference to the following detailed description taken in connection with the accompanying drawing in which:

FIG. 1 is a front perspective view of a croquet post in accordance with this invention; and FIG. 2 is a partial section of the post of FIG. 1 showing the internal mechanism thereof.

Referring now to FIG. 1, an action croquet post designated generally at 10, includes a generally rectangular base 12 and an upstanding hollow column 14 having an ornamental headpiece 16. A bell 18 is mounted to headpiece 16.

A collar 30 is slidably mounted on post 14. One or more ornamental FIGS. 32 and 34 are mounted on collar 30. Post 14 has a spiral groove 40 formed therein.

A target 50 is disposed within a V-shaped ball-receiving portion 52 of base 12. Preferably, target 50 is a round disk. A croquet ball is guided to target 50 by sidewalls 56 and 58 of portion 52. This makes target 50 somewhat easier to hit.

Referring now to FIG. 2, the mechanism that couples the target 50 to collar 30 is illustrated. Target 50 is attached to one end of an actuating plunger 60 that rides within openings in interior walls of 62 and 64 of base 12. Actuating plunger 60 includes a cam surface 70 at the other end thereof on which the lower extremity 78 of actuating rod 80 rides. Rod 80 extends upwardly through the center of hollow column 14.

The upper end of rod 80 is preferably provided with a hammer 84 for striking bell 18. When target 50 is struck by a croquet ball, actuating plunger 60 is urged inwardly, thus raising rod 80 as lower extremity 78 thereof slides upwardly on cam surface 70. Hammer 84 strikes bell 18, producing an audible sound.

Collar 30 includes a central opening 90 for slidably engaging column 14. An inwardly facing projecting member 92 is adapted to ride within groove 40. Projecting member 92 may be urged into collar 30 and out of engagement with the post 14 by pressing against a spring 96.

Groove 40 includes a preferably tapered upper wall 100 and a lower wall 102 that is not tapered. First and second projecting stop members 120 and 122 are attached to rod 80 and extend through openings 124 and 126 in column 14 into groove 40. Stops 120 and 122 are adapted to engage projection 92 when rod 80 is resting on the bottom of cam surface 70. Collar 30 is thereby held in position on post 14. When target 50 is struck, rod 80 is lifted upwardly by cam surface 70 and stop 120 rises above projection 92 thereby allowing collar 30 to begin its decent along post 14. Projection 92 rides on the lower wall 102 of groove 40, causing collar 30 to spin as it travels down post 14. Upon reaching second stop 122, the motion of collar 30 is halted as the stop engages projection 92. When target 50 is once again struck by a croquet ball, stop 122 disengages from projection 92 and collar 30 descends to the bottom of post 14.

Collar 30 may be rapidly raised to the top of post 14 without rotating, since projection 92 is pressed into collar 30 by upper tapered wall 100 without the necessity for the projection to follow groove 40.

While the invention has been described in connection with a presently preferred embodiment thereof, those skilled in the art will recognize that many modifications and changes therein may be made without departing from the true spirit and scope of the invention. For example, while only two stops are shown herein, more stops may be added as desired to provide the capability for indicating multiple hits. While the croquet post as shown provides a spinning indication of a hit, collar 30 need not spin and could travel in a vertical direction only. While a bell and spinning collar are provided in accordance with this embodiment of the invention, other indications of impact by a croquet ball, such as a light, could be provided. Accordingly, the invention is intended to be limited solely by the appended claims.

I claim:

1. A croquet post comprising:

a base;

an upstanding pole mounted on said base;

a movable target mounted on said base;

a vertically movable member slidably mounted on said pole;

latch means on said pole for engaging said movable member and releasably maintaining said member on said pole in a first position spaced above said base; and coupling means connected to said movable target and said latch means, said coupling means responsive to movement of said target to release said latch means to allow said movable member to slide down said pole.

2. The croquet post of claim 1 comprising intermediate latch means for releasably engaging said movable member at a second position between said first position and said base.

3. The croquet post of claim 1 comprising a guide for directing a ball to said target.

4. The croquet post of claim 1 wherein said movable target comprises a plunger attached to said target and said rod has a beveled end engaging said end of said plunger whereby horizontal movement of said plunger causes vertical movement of said rod.

5. The croquet post of claim 1 wherein said movable member comprises a collar slidably mounted on said post.

6. The croquet post of claim 5 comprising a spiral groove in said post.

7. The croquet post of claim 6 further comprising intermediate latch means connected to said rod and projecting through said post into said groove for engaging said movable member at a second position between said first position and said base.

8. The croquet post of claim 7 further comprising an inwardly extending projection on said collar for engaging said groove and said latch means.

9. The croquet post of claim 6 wherein said groove comprises at least one tapered wall.

10. The croquet post of claim 9 further comprising one or more figures attached to said collar.

11. The croquet post of claim 1 wherein said coupling means comprises a rod extending upwardly through said post.

12. The croquet post of claim 11 further comprising a bell mounted adjacent said rod and adapted to be struck by said rod to produce a ring in response to movement of said target.

13. The croquet post of claim 12 further comprising a hammer on said rod adapted to strike said bell.

* * * * *